United States Patent [19]

Steele

[11] Patent Number: 4,947,301

[45] Date of Patent: Aug. 7, 1990

[54] NEON TUBE ELECTRODE HOUSING

[76] Inventor: Charles Steele, 2615 Hauser Blvd., Los Angeles, Calif. 90016

[21] Appl. No.: 347,474

[22] Filed: May 4, 1989

[51] Int. Cl.[5] ..... F21S 3/02

[52] U.S. Cl. ..... 362/219; 362/263; 362/374

[58] Field of Search ..... 362/34, 263, 374, 375, 362/219

[56] References Cited

U.S. PATENT DOCUMENTS

| | | | |
|---|---|---|---|
| 4,181,928 | 1/1980 | Zelina | 362/374 |
| 4,213,665 | 7/1980 | Murray et al. | 362/375 |
| 4,569,004 | 2/1986 | Peterson | 362/263 |
| 4,580,200 | 4/1986 | Hess et al. | 362/374 |

FOREIGN PATENT DOCUMENTS

| | | | |
|---|---|---|---|
| 3346826 | 7/1985 | Fed. Rep. of Germany | 362/374 |

*Primary Examiner*—Stephen F. Husar
*Assistant Examiner*—Sue Hagarman
*Attorney, Agent, or Firm*—Beehler & Pavitt

[57] ABSTRACT

A mounting and housing is provided for the electrode terminal of a neon tube and the electrical conduit extending therefrom. Such housing comprises a pair of walls formed of a shapable insulating material and held in spaced relationship to each other by a base secured to the wall or ceiling surface upon which the housing is to be mounted. The walls define a first cavity which encompasses the neon tube terminal and a second cavity adapted to carry the electrical conduit from the electrode terminal to a transformer or another electrode terminal.

12 Claims, 4 Drawing Sheets

FIG. 11
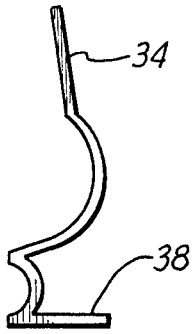
FIG. 14
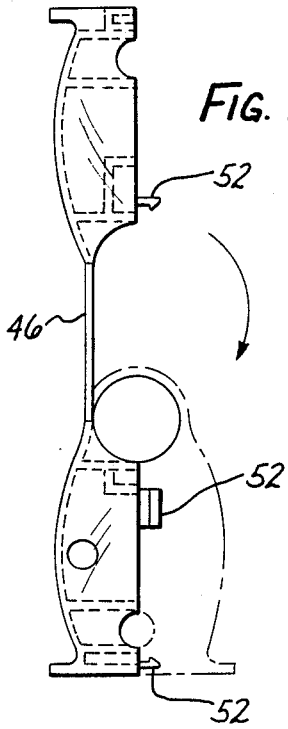
FIG. 12
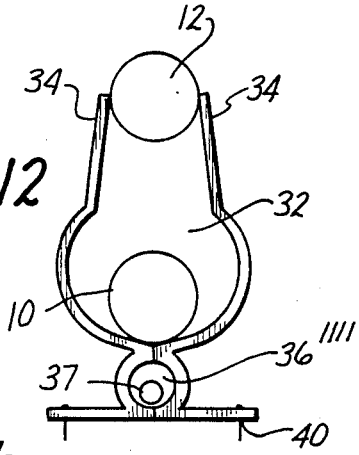
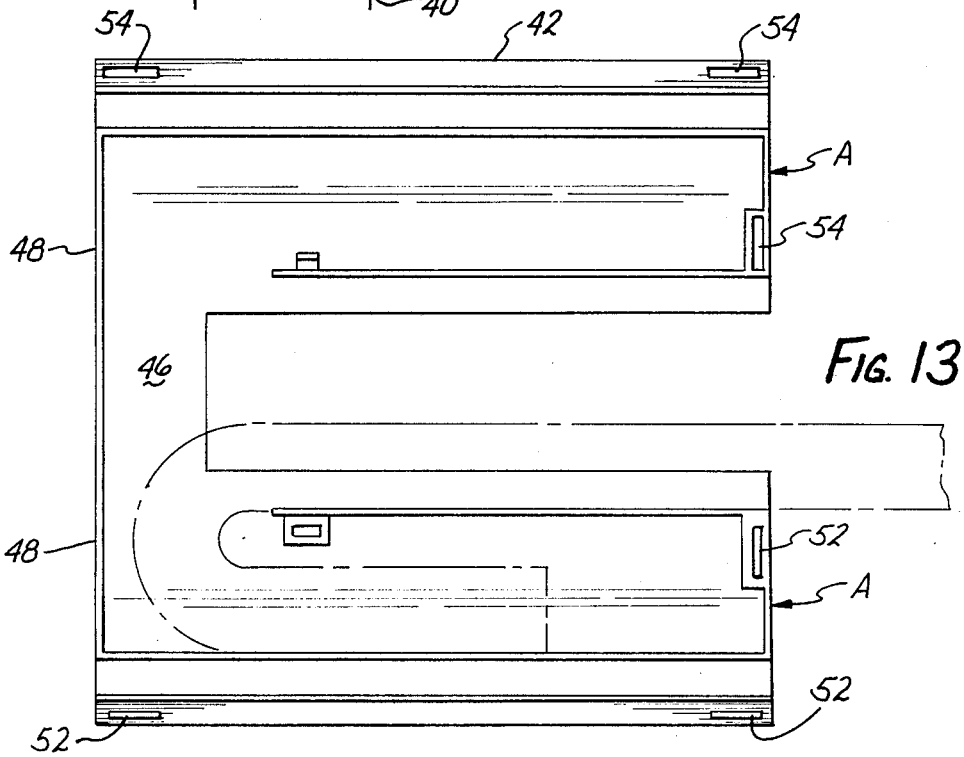
FIG. 13

NEON TUBE ELECTRODE HOUSING

FIELD OF THE INVENTION

This invention relates to the field of neon tube lighting, with particular application to the use of custom made neon tubing for general and decorative lighting.

BACKGROUND OF THE INVENTION

While neon lighting has been available in various forms for some sixty years, its use for general lighting has greatly increased during the last several decades. However, conventional neon lighting has involved tubes of standard finite lengths, the ends of which have been provided with plugs for electrical contacts to be fitted into plug receptacles disposed in standard size housings adapted for attachment to walls or ceilings. An example of such tubing and fixed housing is shown and described in U.S. Pat. No. 4,569,004, issued Feb. 4, 1986.

More recently, custom designed neon tubing has been fabricated to provide lighting in areas in which it is not either practical or desirable to utilize standard housings with fixedly disposed plug receptacles. In situations where it is desired to provide decorative or special neon lighting or lighting in unusual shaped areas, neon tubing generally consists of tubes designed for such areas. Neon tubes of this nature have heretofore been mounted on a wall or ceiling surface by means of clip type plastic elements secured to the wall or ceiling surface and projecting thereform. In addition, mountings may be accomplished by means of glass posts designed to be projected through an orifice in the wall with an electrical conduit extending behind the wall ultimately to the exciting transformer. Where it is not practical to place the electrical conduits behind the wall, it has heretofore been necessary to string them along the wall to extend between the electrode of one tube and that of another tube, or between at least one electrode of such tube and the exciting transformer. Neon tube installations thus made may not only be unsafe, but they are quite unsightly. However, devising and making housing for tube electrodes and conduits for custom installations has heretofore been quite expensive and time consuming.

In general, then, the mounting of custom neon tubing on wall or ceiling surfaces has left much to be desired from the standpoints of appearance, safety and cost.

SUMMARY OF THE INVENTION

The present invention is directed to providing, in the preferred embodiment, aesthetically attractive non-conductive extrusions which may incorporate supports for the neon tubing, as well as provide housings for the electrode ends of such tubings and insulated passages to carry the high voltage conductors extending between adjacently disposed electrode ends of tubings, and/or between the exciting transformer and the electrode terminal of a neon tube. The present invention may take a number of different forms, but preferably it provides an extrusion having a base adapted to be secured to a wall or ceiling from which base there extends a pair of walls spaced apart from each other and terminating in edges which may be separated from each other by a distance at least slightly greater than the diameter of the neon tubing the electrode end of which is to be housed. Said walls may define at least one hollow passage within which may be disposed the electrode end of a neon tube, whether lying in the axis of the tube or turned back 180 degrees from said axis. Desirably, also within or adjacent said passage may be defined a second passage through which may be carried an electrical conductor extending from the tube electrode, either to the electrode of an adjacent tube or the exciting transformer.

In the preferred embodiment, each wall is a separate extrusion of either a plastic or other non-conductive material with its own base which may be brought into face-to-face contact symmetrically with another extrusion, and, when secured by fasteners to the wall or ceiling in such face-to-face contact, the two extrusions provide the desired housing of the present invention. By employing a single extrusion, the cost of providing the housing may be minimized. In this connection, the extrusion may be cut into extended lengths and further easily cut to any particular desired length at the job site. Alternatively, the extrusions may be cut to the desired lengths at the fabricating plant.

In a different embodiment of the invention, integral units may be produced in a mold as two halves in a form generally similar to the pairs of extrusions brought face-to-face as last described, but laid out flat oppositely and joined by a bendable bridge extending between corresponding portions of the upper wall edges and provided with integral mating and closure halves. In use, the bridge is bent forward 180 degrees to bring the two halves into mating engagement where they may be snap locked together by small projections received in molded receptacles.

In another embodiment of the invention, the base of both walls may be extruded integrally. In such extrusion, the cross sectional configuration of the base and walls may be trapezoidal or rectangular, or the walls may be rounded. The base may be secured to the surface on which it is to be mounted, either by fasteners passed through centrally located orifices in the base along the edges of the base, either with or without extended edge footings.

The ends of the wall may either be closed in whole or in part, or left open for abutment to aligned additional extrusions, or for mitering with an adjacent extrusion.

The tube may be supported within the housing by conventional tube supports either secured to the extrusion base or to the ceiling or wall surface through openings in the base.

The invention may be made of an attractive generally rigid plastic material, such as PVC polystyrene or polypropylene, either translucent or colored, as desired for any particular installation, or it may be formed of some other non-conductive material which, when formed in a configuration, will hold its shape.

It will be found that by employing housings fabricated in accordance with the present invention, neon tubing may be most attractively installed to provide custom lighting in different areas, with no unsightly electrode terminal conductors being visible in the installation. In addition, because the conductors are separately housed, the danger of a person coming into contact with a live terminal or conductor is greatly minimized. In addition, in the cases where the tube installations are out-of-doors, the housings can be fabricated and assembled in such a way as to minimize the likelihood of water coming into contact with high voltage electrical terminals or conduits.

Further, extrusions may be made in extended length from which short lengths may readily be cut to provide for neon tube installations of particular desired sizes and locations.

It may thus be seen that the present invention offers many advantages over the prior art.

DESCRIPTION OF THE DRAWINGS

In the accompanying drawings,

FIG. 11 is an end view of a single simplified extrusion which may be placed in face-to-face engagement with a similar extrusion to provide a housing, also as shown in the end view in FIG. 12.

FIG. 13 is an end view of a molded housing, showing in broken lines how the two half-housings are brought together face-to-face to encompass a neon tube end.

FIG. 14 is a plan view of a molded housing of FIG. 13 showing in dotted lines how a tube end would be disposed.

DESCRIPTION OF THE PREFERRED EMBODIMENT

While the preferred embodiment of the invention is shown in FIGS. 11 and 12, and will be fully explained in connection with those drawing Figures, the manner in which the present invention may best be utilized desirably requires an additional explanation of what is shown in FIGS. 1–4 of the drawings.

Figure 1:
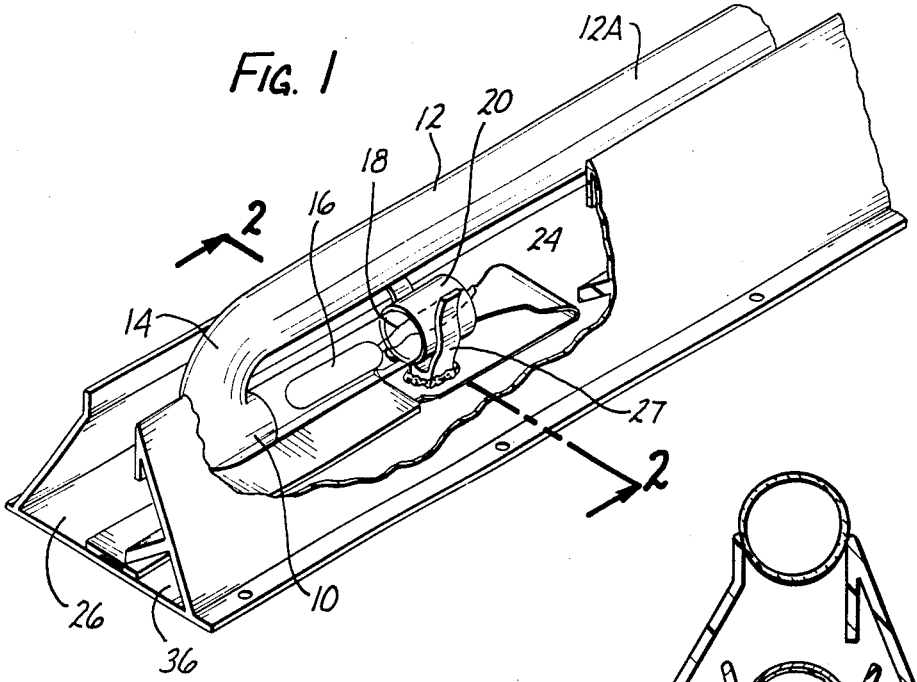
FIG. 1 is a perspective view, broken at one end, of one embodiment of the invention showing the tube mounted therein.
Figure 2:
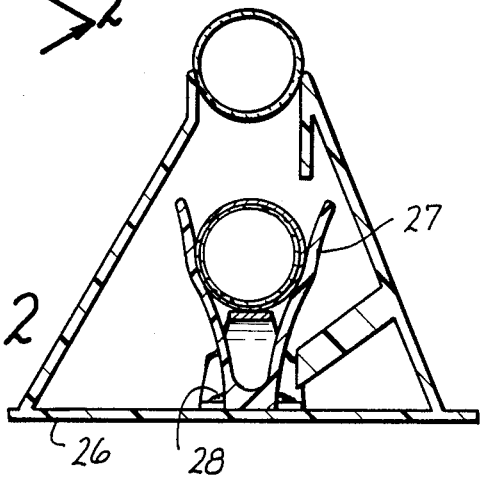
FIG. 2 is a section taken on the line 2—2 of FIG. 1.
Figure 3:
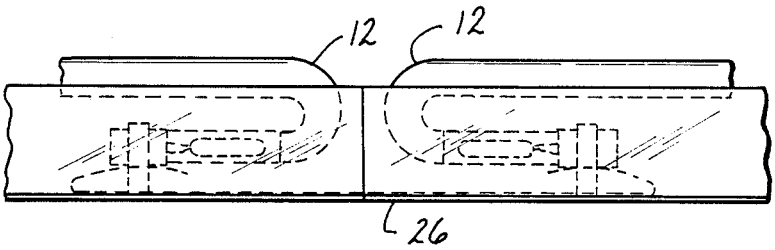
FIG. 3 is a side elevation illustrating the use of a pair of extrusions disposed in end-to-end abutment to house adjacent tube ends.
Figure 4:
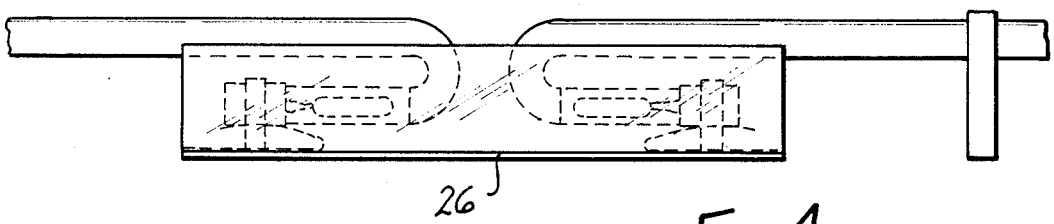
FIG. 4 is a side elevation illustrating the use of a single extrusion housing the adjacent ends of two aligned neon tubes.
Figure 5:
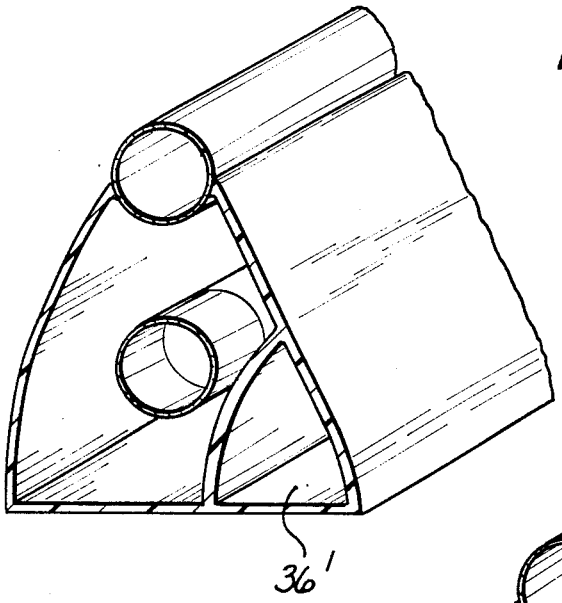
FIG. 5 is a perspective partial end view of a different embodiment of the invention.
Figure 6:
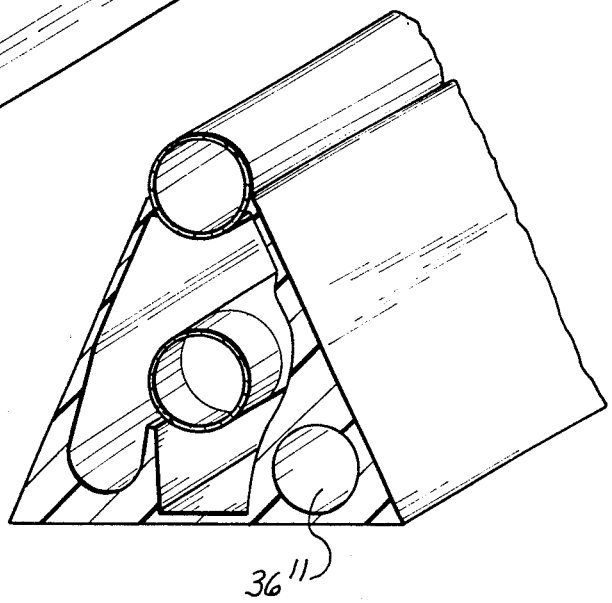
FIG. 6 is a perspective end view of a further embodiment of the invention.
Figure 7:
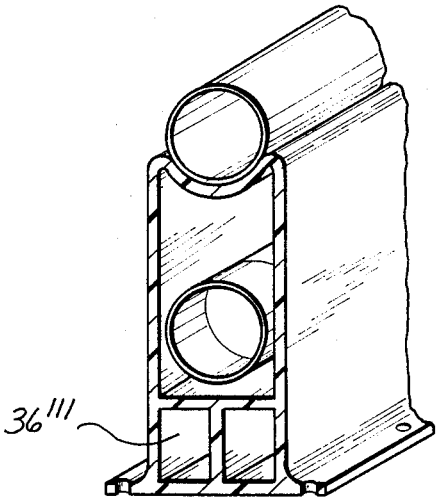
FIG. 7 is a perspective view of a further embodiment of the invention.

In FIG. 1, the end 10 of the neon tube 12 has been bent back at 14 to extend for a brief distance parallel to the straight portion 12A of the tube 12. The end 10 encompasses the electrode 16 connected by a wire or wires 18 to an electrical conductive metal cap 20. This cap 20 may have a wire 21 protruding from its end face for connection to either the exciting transformer (not shown) or to the cap of an adjacent tube, where two tubes are aligned endwise, as shown in FIGS. 3 and 4. Thus, electrical connection to the electrode 16 may be made either by splicing an electrical conduit to a wire 21 which may protrude from the end face of the cap 20, or through some type of mechanical contact made with the side wall of the cap 20. As best shown in FIGS. 3 and 4, when the two tubes 12 are disposed in endwise proximity to each other, their respective end caps 20 may be connected, either by splicing the wires 21 protruding from the respective end caps to a connective conductive element (not shown), or a connection may be made by spring biased electrical contacts 22, 24, interconnected by a strap 26, or by some other electrical conduit (not shown).

Figure 10:
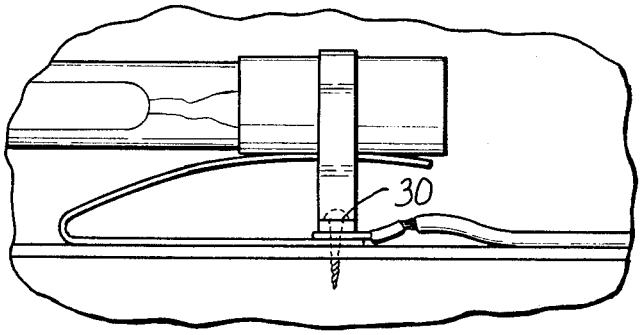
FIG. 10 is an enlarged view of an electrode contact combination as shown in FIGS. 3 and 4.

The present invention is directed to providing means for mounting and housing the end 10 of neon tubing as heretofore described. This housing is preferrably in the form of an elongated extrusion which includes both means to support the bent back end 10 of the tubing, as well as its extended straight segment 12A. To support the end 10 it is sufficient to use currently available resilient fork like elements 27, which may either be made to adhere to the base 26 of the extrusion by the use of an epoxy or PVC cement 28, or by screws 30 as shown in FIG. 10. Alternatively, in the preferred embodiment of the present invention as shown in FIG. 12, the tube end 10 may be supported at the bottom of the cavity 32 defined by the two extrusions 34 which are brought together in face-to-face engagement as shown in FIG. 12.

Desirably, any extrusion forming a tube end housing in accordance with the present invention should define some secondary linear passage 36, 36', 36''', and 36''''. The function of this passage is to carry in at least a partially protected manner any electrical conduit 37 which is brought into the extrusion for contact with the metallic cap 20.

Figure 8:
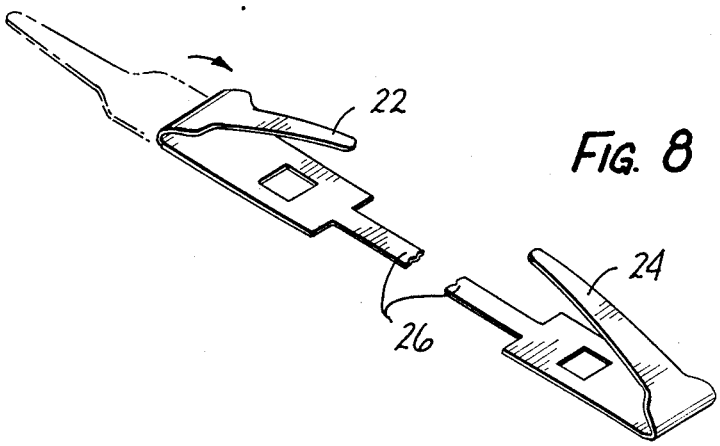
FIG. 8 is a perspective view of a pair of electrode contacts which could be employed in the arrangement shown in FIGS. 3 and 4.
Figure 9:
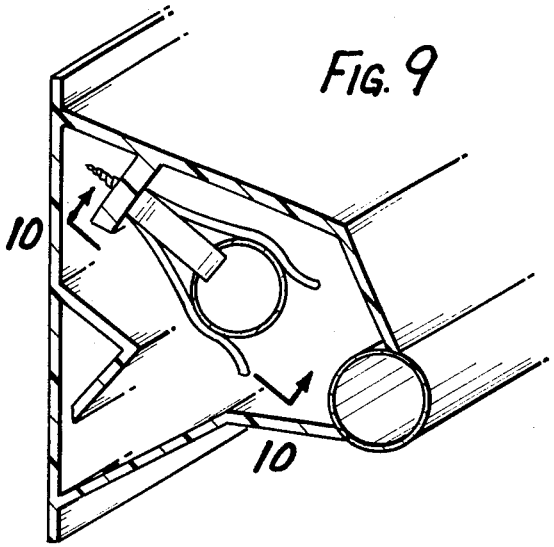
FIG. 9 is a perspective end view of a still further embodiment of the invention designed for wall mounting.

The extrusion embodiment of FIGS. 11 and 12 is preferred because of its complete simplicity and the ease and low cost by which it may be fabricated. A single simple extrusion in the cross sectional configuration shown in FIG. 11 may be extruded in any convenient length to be brought to a job site where it may be cut to provide whatever length housing is required. Two of the desired lengths are thus cut and simply brought into face-to-face engagement as shown in FIG. 12. Since each such extrusion is provided with a lower flange 38, the latter may be drilled wherever necessary to pass screws 40 through the drilled holes to mount the extrusions wherever desired, and to form the cross sectional configuration shown in FIG. 12. When two such extrusions 34 are thus brought together and secured in face-to-face engagement in the manner shown in FIG. 12, it may be seen that a simple convenient support and housing will be provided for the end of one or more neon tubes as shown in FIGS. 3 and 4. Thus, where it is desired to provide aligned supports for the ends of the two tubes 12 which are to be electrically connected together, either two pairs of short lengths of extrusions 34 may be brought together and mounted as shown in FIG. 3 with the exception that, instead of providing contact mountings of the type shown in FIG. 8, the wires 21 protruding from the end caps 20 may be spliced to a conduit 37 which may pass out of the end of the extrusion and back through the passage way 36'''' for splicing to the wire protruding from the other cap after similarly being passed out of the passage way 36'''' and back into the cavity 32.

In the event that the cap 20 is to be connected directly to the exciting transformer (not shown) and no second tube end is aligned in the manner shown in FIGS. 3 and 4, the conduit would be similarly spliced to the protruding cap wire and brought back through the passage way 36'''' for connection to the exciting transformer (not shown).

FIGS. 5, 6, 7 and 9 show alternate forms of an extrusion which could be made to accomplisd the objectives of the present invention. However, each of these would obviously be more complicated to extrude and, in view of such complexity, would be much more expensive. The embodiment of FIGS. 11 and 12, therefore, represents the preferred embodiment of the invention.

While the resultant embodiment of FIGS. 13 and 14 is similar to that of FIGS. 11 and 12, its approach is somewhat different in that, instead of being formed by extrusions, it is molded as an integral unit. Thus, it may be seen that the unit is formed as two halves 42, 44 joined together by a bridge 46. Each half 42, 44 may be configured such that, when brought into face-to-face engagement with the other half, it encompasses an electrode end 10*a* of a neon tube similar to what is shown in FIG. 3. Each half 42, 44 of the molded unit also includes a half of an end wall 48, 50 at each of its ends. Interlockable projections 52 are also provided for insertion in the receptables 54. The end walls 48, 50 may be orificed at 56 to pass an electrical conduit to the electrode.

In use, the housing of the FIGS. 13, 14 embodiment may he nested upon molding and shipped in groups. Since all parts of the housing are integral, a unit may be quickly applied to a tube end, the tube conduit passed through an orificed end wall 48 and the two halves 42, 44 snapped together and screwed or otherwise fastened to the wall or ceiling surface.

Initial mold costs may be expensive, but after such costs have bene amortized over sufficient production of housing units, the molded housing costs should be comparable with those of the extrusions of the FIGS. 11, 12 embodiment.

However fabricated, the housing of the present invention, offers numerous advantages to those persons involved in neon tube installations.

What is claimed is:

1. A housing for a neon tube, said tube having a linear extent with a predetermined cross-sectional diameter and at least one of its end being bent back 180 degrees to extend parallel to said linear extent for a predetermined distance, and capped by an electrode terminal and an electrical conduit connecting said terminal to a source of power, said housing comprising a pair of walls, each of said walls being formed of an insulating shapeable material and having a base securable to a planar surface, each of said walls extending upwardly from its base to present an upper edge parallel to the edge of the other wall and spaced therefrom by a distance equal to the cross-sectional diameter of the tube to define with the other wall a first cavity extending along and surrounding said electrode and an adjacent portion of the neon tube for a predetermined distance, and at least one of said walls further defining a second cavity parallel to the first cavity and adapted to carry the electrical conduit from the electrode terminal to a predetermined destination.

2. The housing as described in claim 1 wherein each of the walls is oppositely symmetrical and said walls are brought together in face-to-face engagement to define the first and second cavities.

3. The housing as described in claim 1 wherein said walls have a common integral base.

4. The housing as described in claim 1 wherein said walls are asymmetrical and said second cavity is defined by an inwardly facing projection in one of said walls.

5. The housing as described in claim 3 wherein the walls are angled inwardly toward each other from their common base.

6. The housing as described in claim 3 wherein neon tube support means are provided to extend upwardly from the common base.

7. The housing as described in claim 1 wherein the walls terminate in at least one common transverse plane and a closure is provided across said wall terminals.

8. The housing as described in claim 7 in which said closure is orificed to pass an electrical conduit extending from the electrode through said closure.

9. The housing as described in claim 7 in which said closure is orificed to pass the neon tube through said closure.

10. The housing as described in claim 7 wherein the parallel walls terminate at their ends in common transverse planes and closures are provided across both said pair of wall terminals.

11. The housing as described in claim 1 wherein each of said walls and its base are extrusions.

12. The housing as described in claim 2 wherein the upper edges of said walls are bridged for a predetermined distance by a foldable plastic material and snap means and receptacles are provided to secure the walls and their bases in interlocking engagement.

* * * * *